United States Patent [19]

Ikeda et al.

[11] Patent Number: 4,910,988

[45] Date of Patent: Mar. 27, 1990

[54] METHOD FOR ROLLING METAL SHEETS

[75] Inventors: Mitsuhiro Ikeda; Kiyoshi Muramatsu; Yuichi Hongo; Toshio Yanai, all of Oita, Japan

[73] Assignee: Nippon Steel Corporation, Tokyo, Japan

[21] Appl. No.: 142,814

[22] Filed: Jan. 11, 1988

[30] Foreign Application Priority Data

Jan. 9, 1987 [JP] Japan ..... 62-1597
Dec. 23, 1987 [JP] Japan ..... 62-323828

[51] Int. Cl.[4] ..... B21B 31/18

[52] U.S. Cl. ..... 72/247; 72/243; 72/245

[58] Field of Search ..... 72/247, 245, 243

[56] References Cited

U.S. PATENT DOCUMENTS

| | | | |
|---|---|---|---|
| 4,683,744 | 8/1987 | Ginzburg et al. | 72/247 X |
| 4,711,116 | 12/1987 | Bald | 72/247 X |
| 4,745,790 | 5/1988 | Teshiba et al. | 72/247 X |
| 4,776,192 | 10/1988 | Oda et al. | 72/247 X |

FOREIGN PATENT DOCUMENTS

| | | | |
|---|---|---|---|
| 50-11859 | 5/1975 | Japan . | |
| 51-7635 | 3/1976 | Japan . | |
| 0061511 | 4/1984 | Japan | 72/247 |
| 0064103 | 4/1984 | Japan | 72/247 |
| 0110401 | 6/1984 | Japan | 72/247 |
| 59-38842 | 9/1984 | Japan . | |
| 60-3881 | 1/1985 | Japan . | |
| 60-51921 | 11/1985 | Japan . | |
| 0250806 | 12/1985 | Japan | 72/247 |

OTHER PUBLICATIONS

Handbook of Iron and Steel, vol. 3 (1), Bases of Rolling, Steel Sheets: pp. 384–386, May 15, 1980.

*Primary Examiner*—W. Donald Bray
*Attorney, Agent, or Firm*—Cushman, Darby & Cushman

[57] ABSTRACT

A pair of tapered work rolls are arranged to confront each other and the work rolls are shifted to locate the side edges of a material to be rolled at the tapered portions of the work rolls, by adding the quantity of the movement of the taper-initiating point by wearing of the rolls to the shift quantity of the rolls, and rolling is carried out while maintaining an effective adjustment of the crown quantity (effective shift quantity). Therefore, defects such as edge drop and high spot can be effectively prevented and the crown quantity can be freely controlled, and accordingly, a desired crown quantity can be easily obtained.

8 Claims, 9 Drawing Sheets

D :roll diameter:710-800 $^{\phi}$ d : top diameter of conical portion[taper shape(tan $\theta$)]

METHOD FOR ROLLING METAL SHEETS

BACKGROUND OF THE INVENTION

1. Field of the Invention

The present invention relates to a hot rolling method. More particularly, the present invention relates to a method for rolling metal sheets, in which changes of the surface shape by wear and thermal expansion of the work roll, and a formation of shape defects in the rolled material, such as high spots, edge drop, and an excessive crown, are prevented.

2. Description of the Related Art

A rolling mill in which work rolls of a 4-high or 6-high rolling machine can be moved in the axial direction thereof are described in detail in Japanese Examined Patent Publication No. 50-11859 and Japanese Examined Patent Publication No. 51-7635. This above technique has led to the creation of a new rolling mill, but the manner of use of this machine has not been established at this time.

The following problem is known in the field of rolling. Namely, as described on pages 384 and 385 of Ordinary Hot Rolling (Hot Strip Rolling), Handbook of Iron and Steel, Volume 3(1), Base of Rolling, Steel Sheets, pages 349–482, published May 15, 1980 by Maruzen K. K., the finish work roll, especially the portion through which the strip edge passes, suffers from extreme wear, and thus, if a number of strips having the same narrow width are rolled and a strip having a broad width is rolled thereafter, a so-called high spot (large projection; see FIG. 4) is formed at the edge portion of the strip, which results in edge build-up at the time of re-rolling at the subsequent step and an impairment of the shape.

Japanese Examined Patent Publication No. 59-38842 proposes a method for avoiding this disadvantage by utilizing the above-mentioned rolling mill. This method is characterized in that rolling is carried out by selectively moving pairs of upper and lower flat work rolls every time one or several materials are rolled.

Methods for controlling the edge drop and the crown quantity by using the above-mentioned new rolling mill are proposed in Japanese Examined Patent Publication No. 60-51921 and Japanese Examined Patent Publication No. 60-3881. According to the former method, a pair of upper and lower work rolls having a conical portion (hereinafter referred to as "taper portion") formed on one end in the axial direction are arranged so that the taper portions of the upper and lower work rolls are located opposite to each other, both the side edges of the material to be rolled are located on the above-mentioned taper portion, and rolling is carried out in this state (hereinafter referred to as "one side tapered work roll shift rolling"). According to the latter method, the former rolling method is applied to somewhere in all the stands, of a hot rough rolling or finish rolling mill except the final stand.

However, as is well-known, in these edge drop-controlling methods, the intended effect can be attained at the initial stage, but when several materials are rolled, the effect is substantially lost.

Namely, an effect of preventing the formation of a high spot can be attained according to the technique disclosed in Japanese Examined Patent Publication No. 59-38842, but an effect of controlling the edge drop or the crown quantity is not attained.

According to the above-mentioned one trapezoid roll shift rolling method, rolling is carried out by mutually shifting the upper and lower work rolls so that the side edge of the material to be rolled is located at a predetermined position of the taper portion apart from the taper-initiating point (the joint portion between the conical end portion and the flat portion), and therefore, the work rolls wear at the portion in contact with the material to be rolled and the taper-initiating point shifts with an advance of rolling. Accordingly, the shape of the work rolls is greatly changed after several materials have been rolled, and reduction of the edge drop and the crown quantity becomes impossible, with the result that high spots are sometimes formed and an abnormal crown is formed in the material. These defects cannot be removed by a compensating mechanism such as a bender.

As is apparent from the above description, a rolling technique of preventing a formation of high spots and simultaneously, controlling the edge drop and the crown quantity in rolling of metal sheets, especially hot rolling thereof, has not been established.

In the above-mentioned ordinary hot strip rolling, in order to prevent a formation of high spots, rolling units are constructed so that strips having a broad width are first rolled and strips having a narrow width are then rolled, except in case of levelling materials of which width are changed step-by-step (see FIG. 5) which shows the levelling materials in the shaded portion.

Note, the term "crown quantity" denotes the value obtained by subtracting the thickness of the material to be rolled at a point 25 mm from the side end, from the thickness of the material at the central point of the material. On the other hand, edge drop is a general term indicating the thickness distribution in the vicinity of the side edge portion. As described hereinafter, there is a strong interrelationship therebetween, and therefore, the crown quantity is mainly used as the evaluation parameter hereinafter.

SUMMARY OF THE INVENTION

A primary object of the present invention is to provide a rolling method in which a formation of high spots is prevented and the edge drop and the crown quantity are controlled so that an appropriate crown quantity is always maintained.

The present inventors investigated the one trapezoid roll shift rolling method, to attain this object, and examined the cause of the above-mentioned problem and the change of the profile of the work roll to analyze the relationship therebetween. It was found that a problem peculiar to the new hot strip rolling method arises, which concerns the relationship between the cause of a formation of high spots and a characteristic of the one trapezoid roll shift rolling.

More specifically, in accordance with the present invention, there is provided a method for rolling metal sheets, which comprises arranging upper and lower work rolls having a conical shape on one end in the axial direction thereof and a cylindrical shape on the other end so that the conical portions of the upper and lower work rolls are located on the upper and lower sides opposite to each other, shifting the upper and lower work rolls in the opposite directions so that both the side edges of the material to be rolled are located at the conical portions of the upper and lower work rolls, respectively, and rolling the material in this state, wherein the upper and lower work rolls are moved in accordance with the movement of the taper-initiating point, which moves according to the quantity of wear of the work rolls caused in the rolling process, and rolling is carried out while locating both the side edges of the material at the conical portions of the work rolls, respectively, by correction of the shift quantity of the work rolls.

DESCRIPTION OF THE PREFERRED EMBODIMENTS

The problem peculiar to the above-mentioned hot strip rolling method will now be diagrammatically described with reference to FIG. 1-(B). During rolling of the first material to the 20th material, the hot strip rolling according to the one side tapered work roll shift rolling technique is carried out by shifting the upper and lower rolls R to the sides opposite to each other so that the side edge of the material S is located at the taper portion T, as pointed out hereinbefore. Accordingly, the taper portion T extending from the taper-initiating point A1, on which the material S impinges, is always in contact with the material S through a rolling pressure as well as the flat portion thereof. Therefore, although the taper portion T wears simultaneously the flat portion, the degree of wear is lower at the point closer to the small-diameter side of the work roll. As a result, the taper-initiating point A1 is substantially shifted toward the small-diameter side of the work roll axis to the point A2, A3, . . . from the point A1 for the first material with an advance of the wear. In the conventional rolling method, however, since rolling is carried out by setting the taper-initiating point (hereinafter referred to as "initial taper-initiating point A1") just after rearrangement of the work rolls and the predetermined shift quantity of the distance between the initial taper-initiating point A1 and the material S (hereinafter referred to as "the absolute shift quantity OW") based on the width of the material, as pointed out hereinbefore, with the advance of the wear, a gap is formed in the taper portion of the work roll on which the side edge E of the material impinges according to the wear of the work roll, as shown in (1), (2) and (3) of FIG. 1-(B), and the taper-initiating point movements toward the side edge E to cause local wear, with the result that the edge drop, which is to be prevented, is increased and a high spot that is to be removed is formed and an abnormal crown is formed in the material S.

Figure 1:
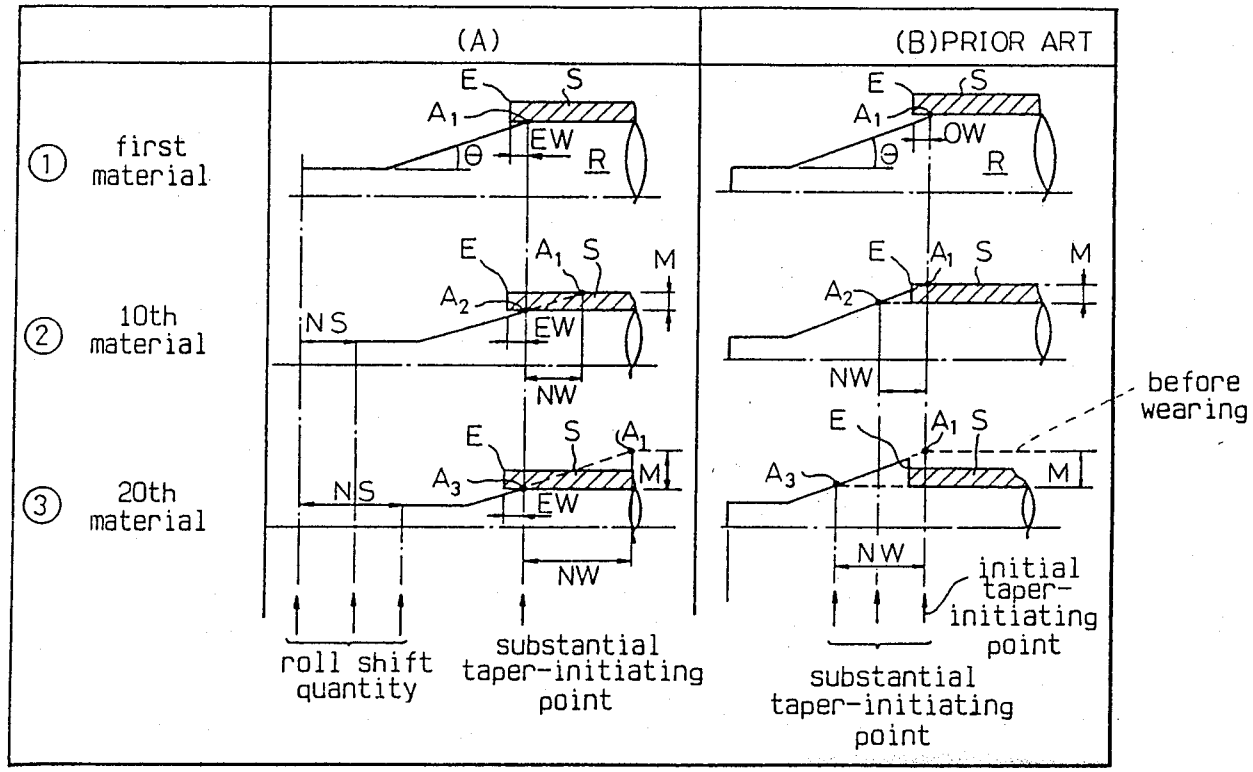
FIG. 1-(A) is a diagram illustrating the construction of an embodiment of the present invention and FIG. 1-(B) is a diagram illustrating the construction of the conventional method.

The phenomenon shown in FIG. 1-(B) was confirmed and this phenomenon analyzed and examined. As a result, the mechanism by which the substantial taper-initiating point shifts to the small-diameter side of the taper portion according to the quantity of wear of the work roll by rolling was found.

The substantial taper-initiating point is defined to be a point of intersection between the extension of the roll outer diameter of the flat portion after wear of the roll and the taper portion or the extension thereof, that is, the point A2 or A3. It was found that the shift quantity NW (mm) of the substantial taper-initiating point can be determined from the taper angle $\theta$ (the angle between the roll axis and the taper surface) of the taper portion of the roll and the wear quantity M (mm) in the radial direction of the flat portion always in contact with the material, accumulated from the first material according to the following formula:

$NW = M/\tan\theta$ (mm) See FIGS. 1-(A) and 1-(B)

Supposing that the wear quantity in the radial direction of the flat portion of the work roll per rolled material is m, the shift quantity of the substantial taper-initiating point per rolled material can be expressed by the formula of $NWm = m/\tan\theta$.

As a result of research into a utilization of this finding, the rolling method shown in FIG. 1-(A) was developed. According to this rolling method, rolling is carried out in the state where the side edge E of the material is shifted by the predetermined quantity EW (mm) from the substantial taper-initiating point A2 or A3 as the base point. Supposing that the taper-initiating point A1 of the roll just after rearrangement is the initial taper-initiating point, the distance between the initial taper-initiating point and the side end portion of the material is NW+EW. This shift quantity EW is called the "effective shift quantity". This rolling method will now be described with reference to FIG. 1-(A). The first material is rolled in the same manner as in the rolling method shown in FIG. 1-(B). In the case of the 10th material, NW corresponding to the wear quantity in the radial direction of the roll caused by rolling of the first through ninth materials is calculated in the above-mentioned manner, and if the work roll is shifted to the right by NW (that is, NS=NW), the state of the 10th material shown in FIG. 1-(A)- 2 is brought about. This NS is called the "roll shift quantity". In the case of the 20th material, only the NW value corresponding to the wear quantity M in the radial direction of the roll caused by rolling of the first through 19th materials becomes larger than the NW value in the case of the 10th material, and the other conditions are the same as in the case of the 10th material, and the state of the 20th material shown in FIG. 1-(A)- 3 is produced. The above-mentioned substantial taper-initiating point A2 or A3 is called the "corrected taper-initiating point". In this case, the above-mentioned side edge E is located at a point intruding into the taper portion by the effective shift quantity EW from the corrected taper-initiating point, as shown in FIG. 1-(A). This EW value may be a constant value or a random value, but should be equal to or larger than 0 (zero).

Figure 2:
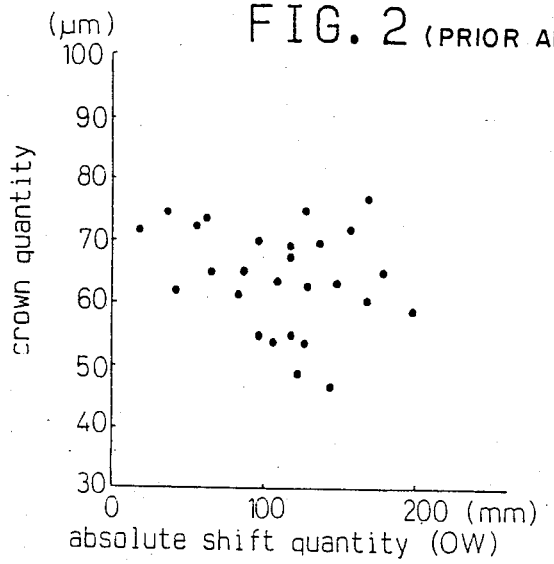
FIG. 2 (PRIOR ART)
FIG. 2 is a diagram illustrating the relationship between the absolute shift quantity OW and the crown quantity of the product.
Figure 3:
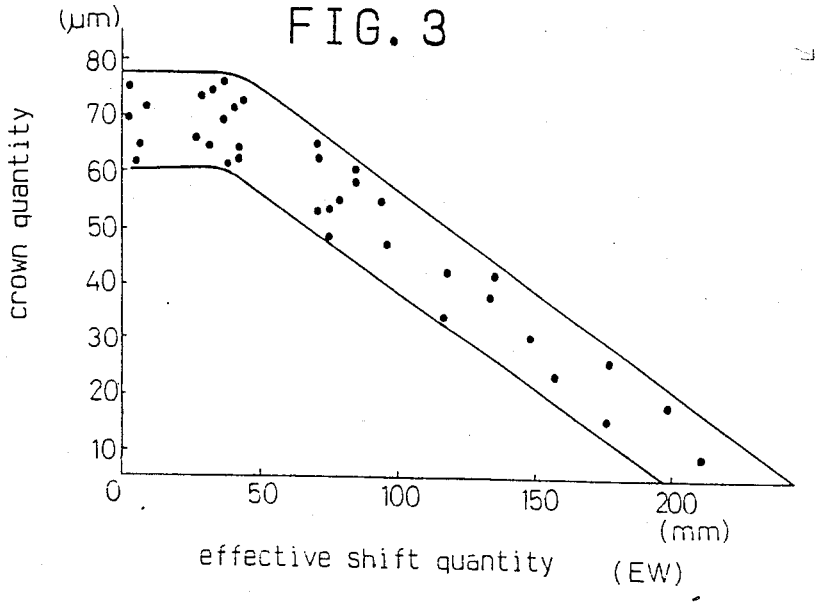
FIG. 3 is a diagram illustrating the relationship between the effective shift quantity EW and the crown quantity of the product.

The crown quantities of materials S rolled according to the methods shown in FIGS. 1-(A) and 1-(B) are shown in FIGS. 2 and 3, respectively, in correspondence to the absolute shift quantity(OW) or effective shift quantity(EW) in the respective methods.

In the absolute shift rolling method shown in FIG. 1-(B), as is apparent from FIG. 2, there is no correlation between the crown quantity of the rolled strip and the absolute shift quantity OW and there is no controllable relationship therebetween. In contrast, in the effective shift rolling method shown in FIG. 1-(A), as is apparent from FIG. 3, there is a close correlation between the effective shift quantity EW and the crown quantity, and the crown quantity of the rolled material S can be estimated from the effective shift quantity. Furthermore, it was confirmed that the effective shift quantity can be set according to the desired crown quantity.

For setting the roll shift quantity NS realizing this effective shift quantity EW, the wear quantity M in the radial direction of the work roll is calculated from the wear quantity mu (mm) in the radial direction based on the preliminarily checked elongation of the rolling roll per unit pressure of the material to be rolled, the rolling length Lm (mm) to the material to be rolled after rearrangement of the roll and the angle $\theta$ between the taper surface and the roll axis according to the formula of $M=mu\times Lm$, and NS is calculated by the above-mentioned formula of $NW=NS=M/\tan\theta$ (mm) and the work roll is shifted so that the calculated NS value is realized. Furthermore, a method may be adopted in which the change of NS corresponding to the wear quantity m in the radial direction of work roll by rolling the previous material is calculated and the work roll is shifted by this change of NS from the position for the previous material.

The above-mentioned calculation of the roll shift quantity NS of the work roll is adopted when the width of the material is constant, and when the effective shift quantity EW is constant. In practical operation, however, the strip width or the effective shift quantity EW is not always constant. The calculation adopted in practical operation will now be described with reference to FIG. 6.

Figure 6:
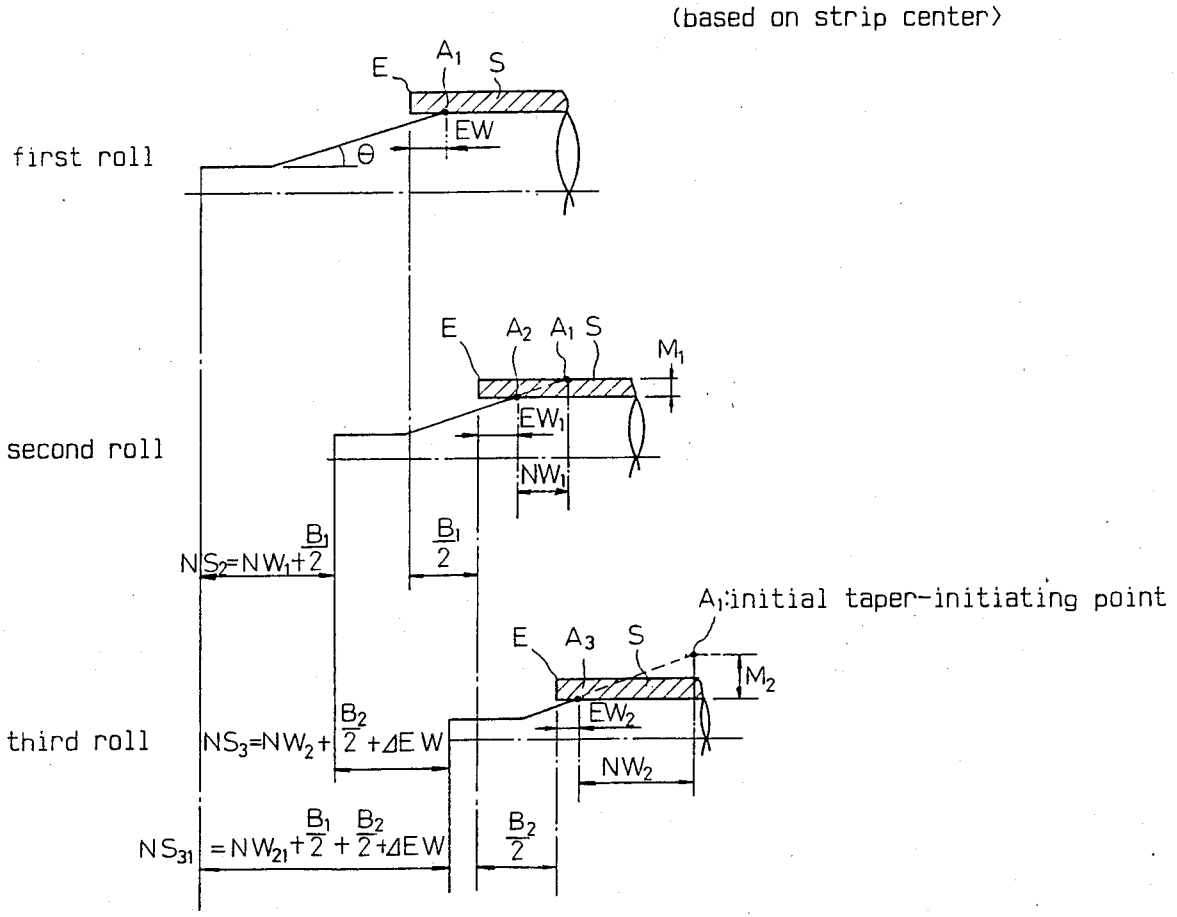
FIG. 6 is a diagram illustrating for explanation of a method of calculating the shift quantity NS of the work roll.

Referring to FIG. 6, the width of the second material is made narrower by B1 than the width of the first material, because of rolling, but the effective quantity EW is the same. In this case, the roll shift quantity NS2 is the value obtained by adding ½ of the change B1 of the width, that is, B1/2, to the movement quantity ($NW1=ml/\tan\theta$) of the taper-initiating point A2, calculated from the wear quantity in the radial direction of the roll at the rolling of the first material ($ml=M1$). That is, the roll shift quantity NS2 is represented by the formula of $NS2=NW1+B1/2$. If the tapered work roll is shifted to the right by NS2 from the roll position at the rolling of the first material as the base, the state for the second material, shown in FIG. 6, is produced.

The width of the third material is narrower by B2 than the width of the second material and the effective shift quantity by $\Delta EW$ ($=EW2-EW1$). In this case, the roll shift quantity NS3 is the value obtained by adding ½ of the change of the width, that is, B2/2, and the change $\Delta EW$ ($=EW2-EW1$) of the effective shift quantity to the movement quantity of the taper-initiating point A3 calculated from the wear quantity m2 in the radial direction of the roll at the rolling of the second material. That is, the roll shift quantity NS3 is expressed by the formula of $NS3=NW2+B2/2+\Delta EW$. The lower work roll shown in the drawing is shifted to the right by NS3 from the roll position at the rolling of the second material as the base, and the state for the third material, shown in FIG. 6, is produced. In other words, the lower work roll is shifted to the right from the roll position at the rolling of the first material as the base by $NS31=NS2+NS3=(NW1+B1/2)+(NW2+B2/2+\Delta EW)=NW21+(B1+B2)/2+\Delta EW$.

Figure 11:
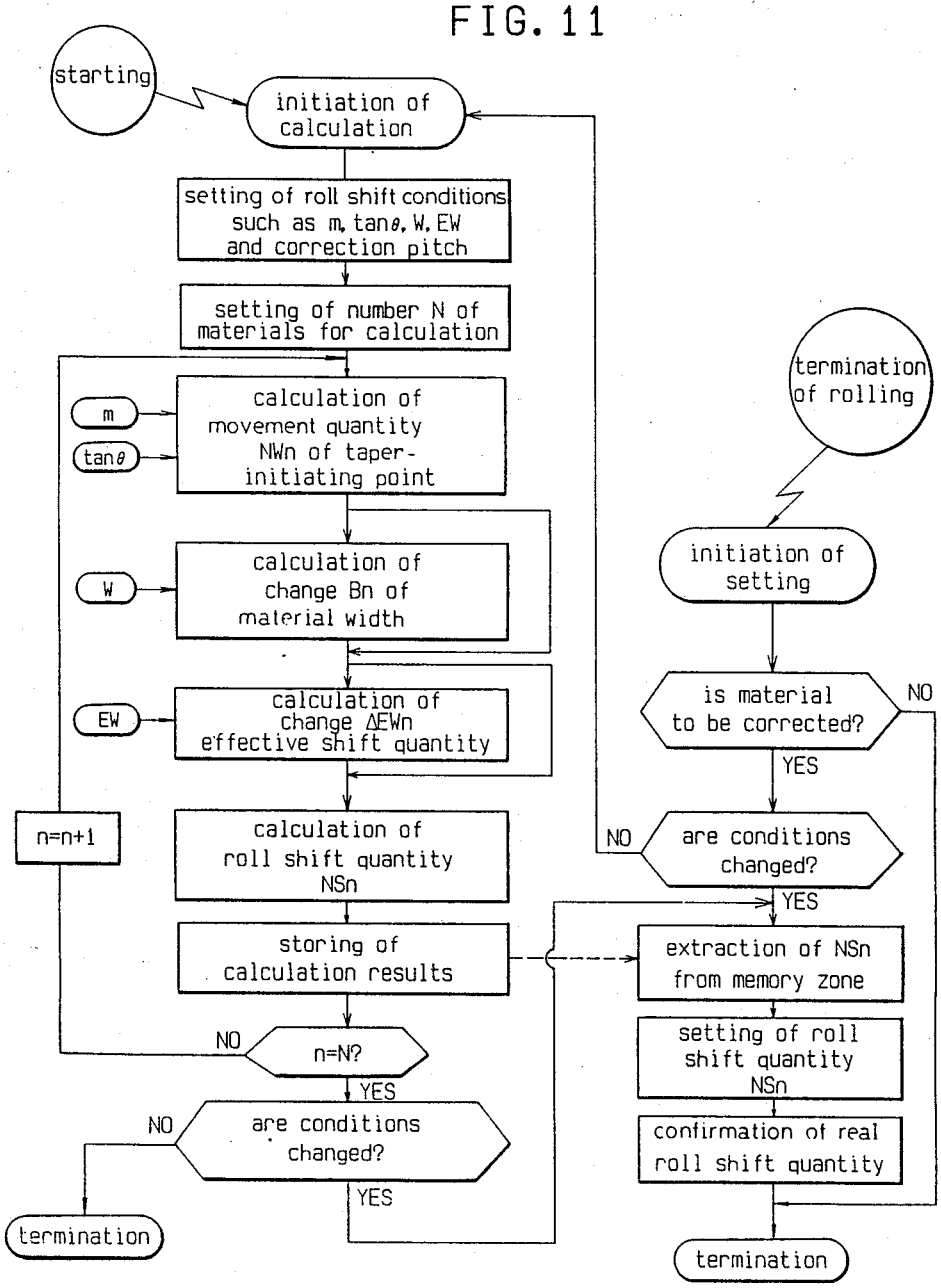

Steps including calculation and setting of the roll shift quantity described above with reference to FIG. 6 are shown in the flow chart of FIG. 11.

Initiation of the calculation is started and the roll shift condition and the number of materials for the calculation are set, the roll shift quantities NSn for N of the materials are then calculated in sequence and stored in a memory zone, and the calculation is terminated. The procedures for setting the roll shift quantity are started after completion of the rolling of each material, and in the case of a material for which the roll shift quantity should be corrected, the roll shift quantity NSn for the n-th roll is extracted from the memory zone, and this NS is set in a roll shift quantity-adjusting device. The roll is shifted by this NS, the completion of the shift is confirmed, and the operation is terminated. If the condition for the calculation of the roll shift quantity is changed when the setting of the roll shift quantity is started on completion of the rolling of the (n=1)th material, initiation of the calculation is started again, the roll shift quantity NSn under the new condition is calculated, and this NSn is set. Note, the correction pitch as the item for setting the roll shift condition is a pitch for correcting the movement quantity NWn of the taper-initiating point, and the correction is performed for each material or every several materials. If the correction pitch is set for every several materials, a setting of the roll shift quantity is not carried out during rolling of these materials. Among one rolling lot (the dimension and composition are the same in the materials to be rolled), the calculation of Bn ordinarily is skipped, and if the effective shift quantity is constant, the calculation of $\Delta EWn$ is also skipped.

In the case of hot rolling, the wear quantity in the radial direction of the workroll per material is generally about 1 to about 10 $\mu$m and the taper angle $\tan\theta$ is about $0.5\times10^{-3}$ to about $2.0\times10^{-3}$. If $m=4$ $\mu$m and $\tan\theta=1.0\times10^{-3}$ are adopted as representative values, the shift quantity NWn of the taper-initiating point per material is 4 mm ($=m/\tan\theta$). Accordingly, where the strip width and effective shift quantity are the same, in order to follow the shift of the taper-initiating point, the work roll may be shifted by 4 mm at every rolling, but since 4 mm is not a large value, the work roll may be shifted by $n\times4$ mm (n is the number of rolled materials) every time several materials (n materials) are rolled. Furthermore, after an optional number of materials are rolled, the work roll may be shifted by the product of the number of rolled materials and 4 mm. For example, a method may be adopted in which, after two materials are rolled, the roll is shifted by 8 mm, four materials are then rolled and the roll is shifted by 16 mm, and one material is then rolled and the work roll is shifted by 4 mm. However, it is obvious that the effect is greater when the roll is shifted every time one material is rolled, and the effect is reduced as the number of materials rolled for one roll shift is increased.

The conventional one side tapered work roll shift rolling method is the absolute shift rolling method, and according to this method, as seen from FIG. 2, it is impossible to freely control the crown quantity and edge drop in the rolled material. In contrast, according to the effective shift rolling method of the present invention, the shift quantity of the work roll is corrected in accordance with the movement of the taper-initiating point corresponding to the wear quantity of the work roll. Therefore, as seen from FIG. 3, the crown quantity and edge drop of the rolled material can be controlled to desired levels. This is a greatest difference between the method of the present invention and the conventional absolute shift rolling method. The present invention also prevents high spots and edge drop by shifting work rolls after one pass. The conventional absolute shift rolling method is established (the effect is attained) on the condition that the work roll wear is not considered. In contrast, in the effective shift rolling method, the practical fact that wear of the work roll occurs is admitted and this wear is effectively utilized. This is a difference in technical concept, and is believed that this difference has a significant effect.

Figure 4:
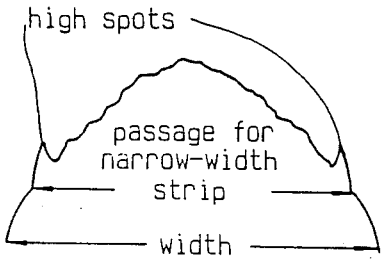
FIG. 4 is a diagram illustrating the cause of a formation of high spots and the state of a formation of high spots (a profile of the broad width material was rolled by using the roll wich rolled the narrow width material)
Figure 5:
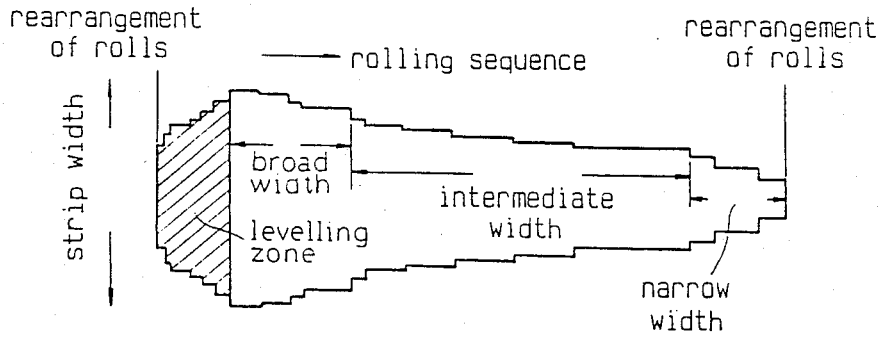
FIG. 5 (PRIOR ART)
FIG. 5 is a diagram illustrating an example of the conventional rolling method (rolling plan between rearrangements of rolls) for preventing a formation of high spots.

It has been confirmed that, according to the present invention, not only is edge drop effectively prevented to avoid a formation of high spots as shown is FIG. 4 but also, by adjusting the effective shift quantity according to the desired crown quantity in the rolled material, the crown quantity can be adjusted to several μm of about 60 to about 80 μm (the edge drop can be simultaneously adjusted). Therefore, a very important control element can be provided according to the present invention.

The present invention will now be described in detail with reference to the following examples.

EXAMPLE 1

Figure 7:
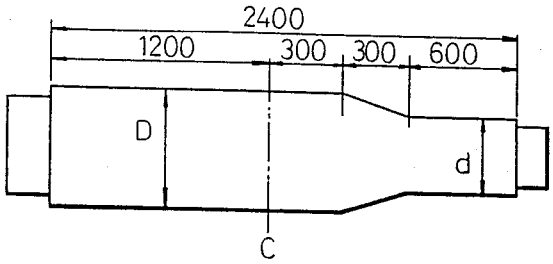
FIG. 7 is a diagram illustrating the profile of work roll.

Materials (strips) shown in Table 2 were rolled under the conditions shown in Table 2 by using a hot finish rolling mill shown in Table 1 and setting work rolls shown in FIG. 7 at the sixth stand as the upper and lower work rolls.

The detailed rolling conditions (the movement quantity NW of the taper-initiating point at every rolling according to the taper angle and the wear quantity m in the radial direction of the work roll per material and the effective shift quantity EW) are shown in Table 3.

The results are shown in the columns "C25" crown quantity (the strip thickness at the central point in the thickness direction—the thickness at the point 25 mm from the side edge) and the column "ΔE125-25" edge drop (the thickness at a point 125 mm away from the side edge in the thickness direction—the thickness at a point 25 mm away from the side edge).

For comparison, the above-mentioned materials were rolled by the same rolling mill under the same conditions as described above except that substantially flat work rolls were set at all of the stands. The results were C25=56 μm and ΔE125-25=40 μm.

It is seen that, in the present invention, both C25 and ΔE125-25 are reduced those obtained in the comparative method, and the larger the tan θ and the larger the EW, the higher the effect.

Figure 8:
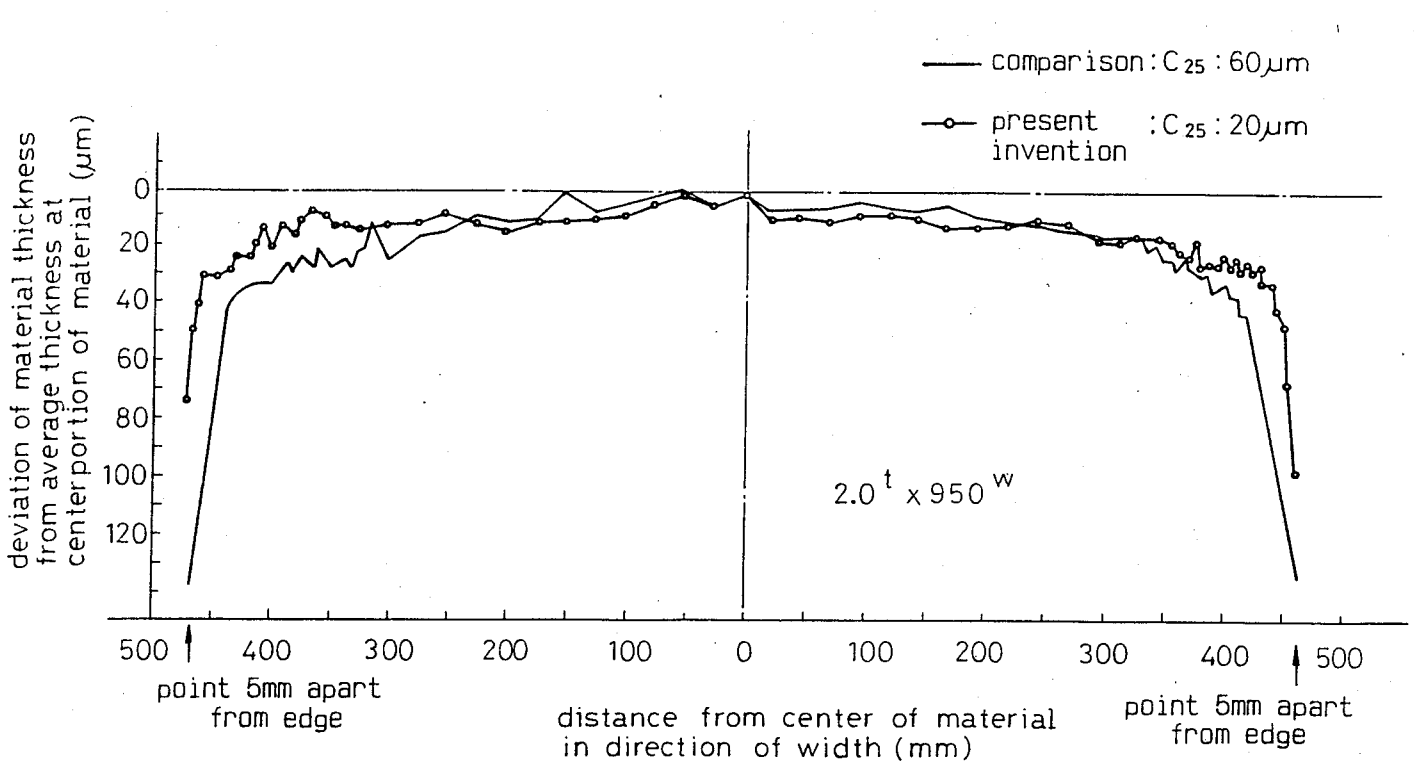
FIG. 8 is a diagram in which actually measured values of the thickness distribution (profile) of the rolled material in the width direction thereof, and the thickness of the central portion of the rolled material, in connection with the method of the present invention and the comparative method, are shown.

The measured values of the profile in the thickness direction obtained when rolling was carried out under conditions of tan $\theta = 2.0 \times 10^{-3}$, a wear quantity m of 4 μm per material and an effective shift quantity EW of 80 mm are shown in FIG. 8, together with those obtained in the comparative method. From FIG. 8, it is seen that, in the profile of the material rolled according to the rolling method of the present invention, the edge drop is controlled not only at a point 25 mm from the side edge (expressed by C25) but also in the vicinity of a point 25 mm away from the side edge and at a point very close to the side edge. Therefore, the improvement of the crown quantity C25 means that the thickness characteristic (profile) is improved not only at a point 25 mm away from the side edge but also in the vicinity of a point 25 mm away from the side edge and at a point very cloe to the side edge.

TABLE 1

| Finish rolling mill No. | | $F_1$ | $F_2$ | $F_3$ | $F_4$ | $F_5$ | $F_6$ | $F_7$ |
|---|---|---|---|---|---|---|---|---|
| Work roll diameter | (ϕmm) | 800 | 760 | 770 | 740 | 710 | 770 | 800 |
| Work roll barrel length | (mm) | 2250 | 2250 | 2250 | 2400 | 2400 | 2400 | 2400 |
| Shift quantity of work roll | (mm) | — | — | — | ±150 | ±150 | ±150 | ±150 |
| Back-up roll diameter | (ϕmm) | 1570 | 1570 | 1570 | 1570 | 1570 | 1570 | 1570 |
| Back-up roll barrel length | (mm) | 2250 | 2250 | 2250 | 2250 | 2250 | 2250 | 2250 |
| Reduction ratio | (%) | 50.7 | 37.4 | 40.1 | 36.3 | 34.1 | 27.3 | 11.8 |
| Rollable thickness | (mm) × width (mm) | 1.2 × 600 – 20 × 2140 | | | | | | |

TABLE 2

| | Items | Conditions |
|---|---|---|
| 1. | Strip conditions | |
| | Kind of steel | Ordinary steel |
| | Thickness at inlet of finish rolling mill | 40 mm |
| | Thickness at outlet of finish rolling mill | 2.0 mm |
| | Width at outlet of finish rolling mill | 950 mm |
| 2. | Rolling conditions | |
| | Strip temperature at inlet of finish rolling mill | 1030° C. |
| | Strip temperature at outlet of finish rolling mill | 860° C. |
| | Winding temperature | 600° C. |
| Rolling load | 800–2000 tons | |

TABLE 3

| Wear quantity | NW | EW | $\Delta E_{125\text{-}25}$ | $C_{25}$ |
|---|---|---|---|---|
| | (i) tan $\theta = 0.5 \times 10^{-3}$ | | | |
| 4 μm/material | 8.0 mm | 200 mm | 32 μm | 42 μm |
| 8 m/material | 16.0 mm | 150 mm | 34 μm | 44 μm |
| | (ii) tan $\theta = 1.0 \times 10^{-3}$ | | | |
| 4 μm/material | 4.0 mm | 150 mm | 28 μm | 38 μm |
| 8 μm/material | 8.0 mm | 100 mm | 32 μm | 42 μm |
| | (iii) tan $\theta$ $1.5 \times 10^{-3}$ | | | |
| 4 μm/material | 2.7 mm | 100 mm | 16 μm | 22 μm |
| 8 μm/material | 5.3 mm | 50 mm | 26 μm | 34 μm |

TABLE 3-continued

| Wear quantity | NW | EW | $\Delta E_{125-25}$ | $C_{25}$ |
|---|---|---|---|---|
| | (iv) tan $\theta = 2.0 \times 10^{-3}$ | | | |
| 4 μm/material | 2.0 mm | 11 80 mm | 15 μm | 18 μm |
| 8 μm/material | 4.0 mm | 40 mm | 28 μm | 32 μm |
| | (v) Comparison | | | |
| | | | 40 μm | 56 μm |

EXAMPLE 2

Figure 9:
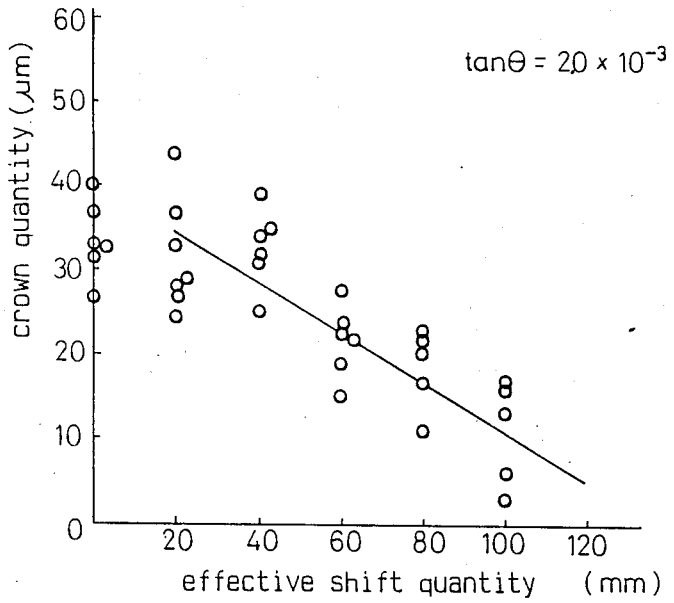
FIG. 9 is a graph showing the results obtained in Example 2.

Materials shown in Table 2 were rolled under the conditions shown in Table 2 by using the hot finish rolling mill shown in Table 1 as in Example 1 and setting work rolls (tan $\theta=2.0\times10^{-3}$) at the sixth stand as the upper and lower work rolls, and rolls having a convex crown of 400 to 200 μm at the first to third stands of the former stage as the work rolls. The results are shown in FIG. 9. In this example, the estimate value of the wear quantity of the roll was about 4.2 μm per material. When the movement of the taper-initiating point was corrected according to the wear quantity of the roll every time two materials were rolled, it was confirmed that the measured values were included within the variation range shown in FIG. 9. Also, the high spots as shown in FIG. 4 will not occur.

EXAMPLE 3

Figure 10:
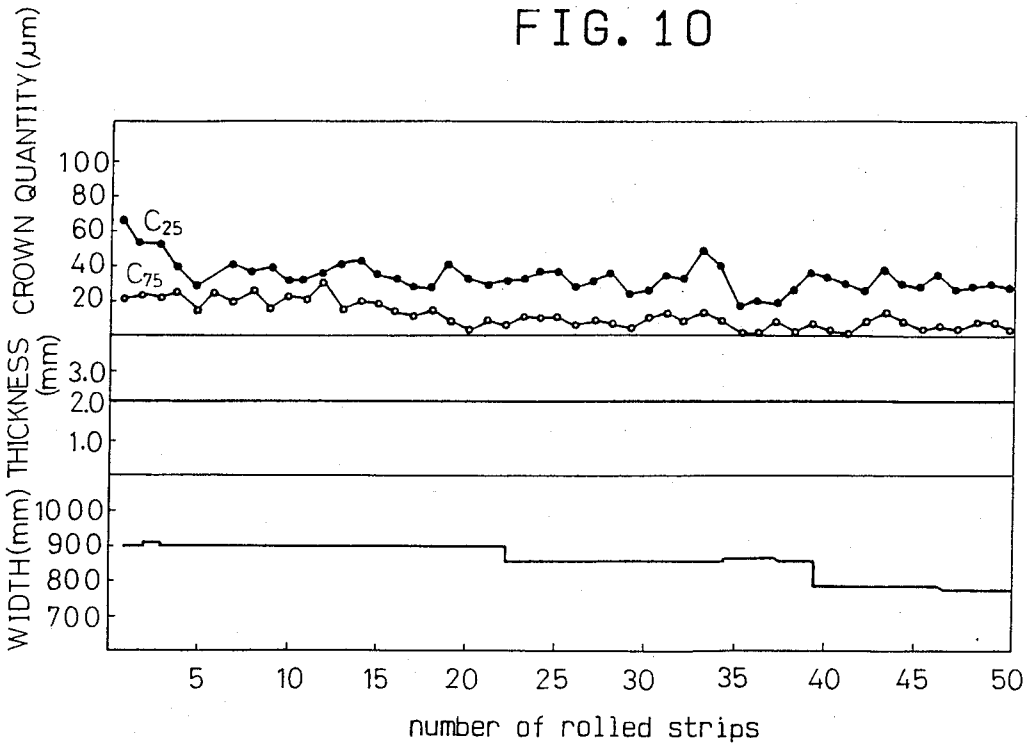
FIG. 10 is a graph illustrating the results obtained in Example 3 of the present invention; and, FIG. 11 is a flow chart.

Fifty materials shown in Table 2 (the width was changed) were rolled in succession under the conditions shown in Table 2 by using the finish rolling mill shown in Table 1 as in Example 1, and setting work rolls shown in FIG. 7 (tan $\theta=1.0\times10^{-3}$) at the sixth stand as the work rolls and work rolls having a substantially flat crown at all of other stands. The results are shown in FIG. 10. In this example, the effective shift quantity was set between 80 mm and 120 mm and the wear quantity m per material was 3 μm~6 μm. The correction of the movement of the taper-initiating point by the wear of the roll was performed for every two materials within the range of the 25th material to the 33rd material and the correction was performed for every material in other materials. In FIG. 10, C25 and C75 indicate the crown quantities at a point 25 mm away from the side edge and a point 75 mm away from the side edge, respectively. It is seen that the effect of the present invention was stably attained even in the 50th rolled material, and a high effect was attained even at the point where the thickness of the material to be rolled was changed and the high spot did not occur.

From the results of the foregoing examples, it is evident that, with reference to the crown quantity, not only the crown-adjusting function such as the conventional roll-bending function but also the adjusting function by the effective shift rolling method can be attained, and the desired crown quantity can be formed with a high precision. It is also seen that, by applying the working conditions to optional stands in the continuous hot rolling line and carrying out the rolling in this state, the crown quantity-adjusting function can be utilized most efficiently, and the adaptability to the rolling operation and the operation efficiency can be greatly improved.

We claim:

1. A method of rolling metal sheets of a material to be rolled, comprising the steps of:

arranging upper and lower work rolls having a conical portion on one end in the axial direction thereof and a cylindrical shape on the other end so that the conical portions of the upper and lower work rolls are located on upper and lower sides opposite to each other;

shifting the upper and lower work rolls in opposite directions to one another so that both side edges of the material to be rolled are located at the conical portions of the upper and lower work rolls, respectively;

estimating, when rolling the material, the wear quantity m of the work rolls per material;

calculating a movement quantity of the taper-initiating point from a quantity obtained by multiplying said wear quantity m by a taper angle tan $\theta$;

after rolling said material, correcting a shift quantity of the work rolls using said movement quantity of the taper-initiating point; and locating both the side edges of the material at the conical portions of the work rolls as determined according to the corrected shift quantity of the work rolls.

2. A method for rolling metal sheets according to claim 1 comprising the further steps, after rolling of said material, of correcting the shift quantity of the work rolls by a sum of said movement quantity of the taper-initiating point and one half of the change of the width between said material and the subsequent material to be rolled, and rolling the subsequent material.

3. A method for rolling metal sheets according to claim 1 comprising the further steps, after rolling of said material, of correcting the shift quantity of the work rolls by a sum of the movement quantity of the taper-initiating point, one half of the change of the width between said material and the subsequent material to be rolled and the change of the effective shift quantity, and rolling the subsequent material.

4. A method for rolling metal sheets according to claim 1, wherein the shift quantity of the work rolls is corrected every time one material is rolled.

5. A method of rolling metal sheets according to claim 1, wherein the shift quantity of the work rolls is corrected every time one material is rolled.

6. A method of rolling metal sheets according to claim 3, wherein the shift quantity of the work rolls is corrected every time one material is rolled.

7. A method of rolling metal sheets according to claim 5, comprising the step of correcting the shift quantity of the work rolls every time a different one of multiple materials are rolled, the shift quantity of the taper-initiating point being calculated from the quantity obtained by multiplying the total wear quantity of a plurality of the wear quantities of the work rolls per material by the taper angle tan $\theta$.

8. A method of rolling metal sheets according to claim 5, comprising the step of correcting the shift quantity of the work rolls every time a different one of multiple materials are rolled, the shift quantity of the taper-initiating point being calculated fom the quantity obtained by multiplying the total wear quantity of a plurality of the wear quantities of the work rolls per material by the taper angle tan $\theta$.

* * * * *

UNITED STATES PATENT AND TRADEMARK OFFICE

CERTIFICATE OF CORRECTION

PATENT NO. : 4,910,988

DATED : March 27, 1990

INVENTOR(S) : IKEDA et al.

It is certified that error appears in the above-identified patent and that said Letters Patent is hereby corrected as shown below:

Col. 10, Claim 5, line 2: Change "1" to --2--.

Claim 7, line 2: Change "5" to --4--.

Signed and Sealed this

Twenty-fifth Day of June, 1991

*Attest:*

*Attesting Officer*

HARRY F. MANBECK, JR.

*Commissioner of Patents and Trademarks*